United States Patent [19]

James

[11] 4,451,944

[45] Jun. 5, 1984

[54] NET BED

[75] Inventor: David R. James, Glenyard, England

[73] Assignee: James Industries Limited, Gloucester, England

[21] Appl. No.: 282,165

[22] Filed: Jul. 10, 1981

[30] Foreign Application Priority Data

Jul. 11, 1980 [GB] United Kingdom ..... 8022764

[51] Int. Cl.[3] ..... A61G 7/10

[52] U.S. Cl. ..... 5/61; 5/83; 5/85

[58] Field of Search ..... 5/61, 88, 65, 83–85; 440/106

[56] References Cited

U.S. PATENT DOCUMENTS

| | | | |
|---|---|---|---|
| 680,814 | 8/1901 | Smith | 5/88 |
| 936,107 | 10/1909 | Floyd | 5/88 |
| 2,100,663 | 11/1937 | Maddox | 5/88 |
| 3,108,290 | 10/1963 | Partridge | 5/88 |
| 3,383,717 | 5/1968 | Underwood | 5/61 |
| 3,401,410 | 9/1968 | Welborn et al. | 5/61 |

FOREIGN PATENT DOCUMENTS

| | | | |
|---|---|---|---|
| 2033739 | 5/1980 | United Kingdom | 5/61 |

*Primary Examiner*—Alexander Grosz
*Assistant Examiner*—Michael F. Trettel
*Attorney, Agent, or Firm*—Cushman, Darby & Cushman

[57] ABSTRACT

A bed comprises a flexible web, preferably of mesh or net form, on which a patient is supported and which is slung between two parallel shafts. The ends of the web are respectively wound on to the two shafts which can be turned by end winding handles through drive clutch/brake units of the shafts. At the other ends the shafts have plain bearing assemblies. The drive units are non-rotatably received in support crutches of a frame of the bed, and these crutches can pivot about inclined axes in the manner of the rowlocks of a rowboat. The bearing assemblies are received in fixed crutches formed to allow a permissible range of angularity of the shafts in these crutches when removed from the drive end crutches. Each end of each shaft is retained captive to the frame by a chain or cord of length such that if a shaft is lifted out of the support crutch at one end and lowered to hang on the corresponding cord, while remaining in the crutch at the other end, the shaft is constrained so that the lowering movement lies inside an arc which limits the angularity of the shaft to within a permissible range thereof.

8 Claims, 7 Drawing Figures

NET BED

BACKGROUND OF THE INVENTION

1. Field of the Invention

This invention relates to beds of the type in which a patient is supported on a flexible web slung between two generally parallel shafts on to which the ends of the web are respectively wound. Thus the shafts can be turned in the same direction to transfer the web from one shaft to the other, enabling a patient lying on the web to be rolled over for repositioning thereon, or they can be turned in opposite directions to raise or lower the patient with respect to a conventional mattress or other support surface below the web.

2. Description of the Prior Art

When the web is of web or net form, as disclosed in U.K. Pat. Specification No. 1447163 and U.S. Pat. Specification No. 3905055, such a bed is particularly valuable in the prevention and treatment of bed sores. Beds of the type concerned are hereinafter referred to generally as "net beds" which term where appropriate is to be considered broadly to include a flexible web of any form, i.e. not necessarily mesh or net form although this is normally preferred.

Net beds are in general use as attachments for existing hospital beds, comprising support framework with four spaced support crutches for the rotatable shafts which can normally be lifted out of the crutches so as to hang down at the sides of the bed. In U.S. Pat. No. 4,270,234 there is disclosed such a net bed arrangement with a collapsible framework which is universal, in the sense that it can be used with almost any existing bed without the addition of special fittings or adaptors and even without the employment of tools.

With existing beds it is possible for the framework to be damaged if a shaft is not lifted "cleanly" out of its two support stirrups. When it is engaged only at one end, as may happen when lifted with one hand, it functions as a lever which enables very considerable and damaging twisting moments to be applied to the stirrup with which it is still engaged, and this can seriously damage and distort the framework.

SUMMARY OF THE INVENTION

The object of the invention is to provide a shaft and stirrup arrangement in which a shaft can be disengaged and lowered at only one end without damage to the framework.

To this end, according to the invention, the shafts of a bed of the type concerned each have bearing assemblies demountably supported in spaced support crutches of a framework of the bed so as to have at each crutch an available permissable range of angular movement. Each end of each shaft is held captive with respect to the framework, by means of a chain, cord or the like of such length that when one end of a shaft is lifted out of a corresponding support crutch and lowered so as to hang freely on the corresponding chain or cord it is constrained to move inside an arc such that the resultant angular movement at the other end of that shaft, with the latter remaining in its associated support crutch, lies within said permissible range.

In the bed disclosed in said U.S. Pat. No. 4,270,234 each shaft comprises an assembly including end fittings providing the bearing assemblies. At one end a plain bearing assembly has an annular plain bearing member which engages directly in a support crutch, whereas the other end fitting is a combined bearing and drive clutch/brake unit with a non-circular housing which nonrotatably engages in the corresponding crutch. A generally similar shaft assembly arrangement can suitably be employed in a bed according to the present invention, all that is necessary being to form the bearing member, drive housing and/or crutches to provide said permissible range of free angular movement.

So far as the non-drive end of each shaft is concerned the premissible range of angular movement can easily be achieved by forming said bearing member with adequate clearance relative to the corresponding crutch. However, at the drive end it is preferably achieved by suitable formation or mounting of the crutch so that the drive housing in the operative shaft position remains a good non-rotational fit within the crutch to avoid fretting of the engaged surfaces. This can, for example, be achieved in simple fashion by using a crutch which is rotatably mounted in the framework much in the manner of a rowlock of a rowboat.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same of equivalent principles may be used and structural changes may be made as desired by those skilled in the art without departing from the present invention and the purview of the appended claims.

DESCRIPTION OF THE PREFERRED EMBODIMENT

Figure 1:
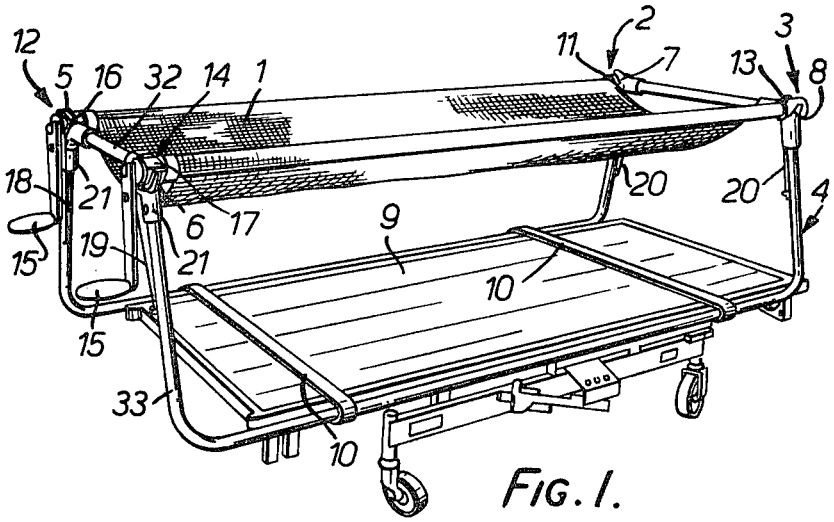
FIG. 1 is an end perspective view of a complete net bed, mounted on a standard hospital bed.
Figure 2:
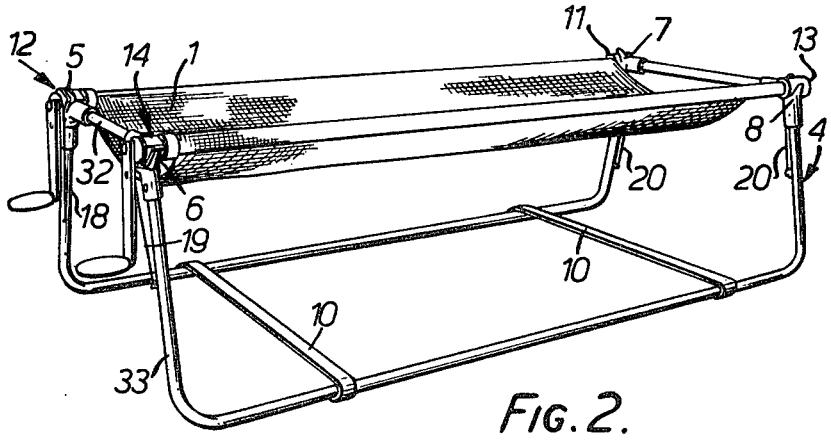
FIG. 2 is a similar view of the net bed used in free-standing form.

The net bed illustrated comprises a flexible web 1 of mesh or net form slung between two parallel winding shaft asssemblies 2 and 3 on to which the ends of the net 1 are respectively wound as clearly shown in FIGS. 1 and 2. A collapsible support frame 4 which is mainly of tubular construction provides spaced support crutches 5 and 6 at one end of the frame and similarly spaced support crutches 7 and 8 at the other end of the frame. The adjacent ends of the shaft assemblies 2 and 3 are respectively supported in these crutches and the frame 4 can be used either, as shown in FIG. 1, supported on the base 9 of a conventional bed below the mattress (not shown) thereof or in free-standing form as shown in FIG. 2. The frame 4 has bottom cross members 10 which in the former case, as shown in FIG. 1, extend across and support the net bed on the base 9.

The shaft assemblies 2 and 3 each comprise a tubular shaft member, around which the corresponding end of the net 1 is wound, extending between end fittings 11, 12 or 13, 14. Each of the end fittings 12 and 14 includes a winding handle 15 by which the shaft is turned through a drive clutch/brake unit 16 or 17. The units 16 and 17 have housings of square external profile so as to engage non-rotatably in the corresponding support crutches 5 and 6. The shaft assemblies 2 and 3 are handed in the sense that they can only be fitted, respectively, at the left-hand and right-hand sides of the frame 4. To this end the housings of the units 16 and 17 are of different size so that the larger one thereof can only be fitted in the correct support crutch 5 or 6.

The end fittings 11 and 13 are identical and each comprises an annular plain bearing member which rests in the corresponding support crutch 7 or 8 and allows free rotation of the corresponding shaft when the associated handle 15 is turned. The end fittings 11, 12, 13 and 14 of the shaft assemblies 2 and 3 and the end support crutches 7 and 8 are generally as described in detail in said U.S. Pat. No. 4,270,234, to which reference should be made if further detailed description is required. The end fittings 11 and 13 rest loosely in the support crutches 7 and 8 so as to allow either of the end fittings 12 or 14 to be lifted out of the support crutch 5 or 6 and lowered to an inoperative side position in which it hangs down at the side of the frame 4 on a length of cord 18 or 19 by which the corresponding end of the shaft assembly concerned is held captive to the frame 4. The fit of the end fittings 11 and 13 in the support crutches 7 and 8 is such as to accommodate the angularity of a shaft assembly as it is lifted out of the corresponding support crutch 5 or 6 and lowered so as to hang on the corresponding cord 18 or 19 without a damaging twisting moment being applied to the corresponding end support crutch 7 or 8 by the lever which the corresponding shaft provides.

The end fitting/support crutch arrangements at the other end of the frame 4 are also such as to accommodate the angularity of the shaft assemblies 2 and 3 if they are lifted out of the corresponding support crutches 7 and 8 and lowered on the attachment cords 20 shown in FIG. 1. However, in view of the drive/brake function performed by the end units 16 and 17 these cannot be a fit such as to allow the required angular movement within the support crutches 5 and 6 themselves if fretting of the housings is to be avoided. Accordingly the support crutches closely receive the fitting rectangular housings of the drive/brake units 16 and 17 and are rotatably mounted in corner fittings 21 of the frame 4 in the manner of a rowlock of a rowboat. This, and the carefully chosen lengths of the cords 18, 19 and 20 are the important features of difference of the arrangement as compared with the otherwise functionally similar arrangement disclosed in said U.S. Pat. No. 4,270,234.

The novel crutch arrangement is illustrated in detail in FIGS. 2 to 5 of the drawings, the support crutch 6 here being illustrated. The crutch has a rectangular support recess 22 which closely receives the rectangular housing 17*a* of the corresponding unit 17 (shown in broken lines in FIG. 3). Apart from the "handed" size of this recess 22 the crutches 5 and 6 are identical. The crutch 6 has a pivot spindle 23 which is rotatably received in a bearing bush 24 in the corresponding angular corner fitting 21 of the frame 4. Axial retention is achieved by a location washer 25 fixed to the end of the spindle 23 by a retaining bolt 26 which engages a central screw-threaded blind bore 27 in the spindle 23. A thrust bearing washer 28 is fitted between the crutch 6 and the fitting 21, and another such washer 29 is fitted between the fitting 21 and the washer 25.

The corner fitting 21 is of symetrical form with two mutually inclined and projecting limbs 30 and 31 which are bored out to receive, respectively, a top frame tube member 32, which in the frame 4 directly interconnects the two corner fittings 21, is disposed horizontally providing an inclined pivot axis 34 for the crutch 6, this axis being inclined at an angle of about 55° to the horizontal.

Figure 4:
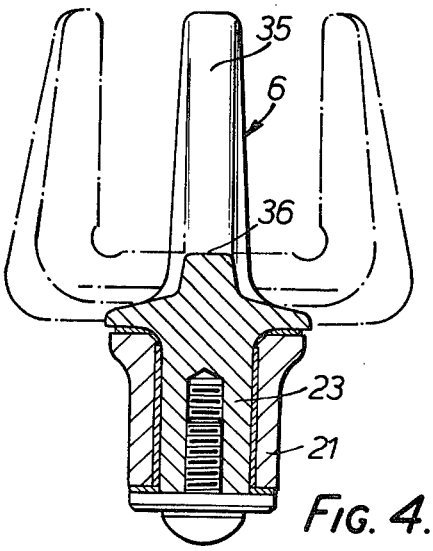
FIG. 4 is a cross-sectional view on the line III—III in FIG. 3.
Figure 5:
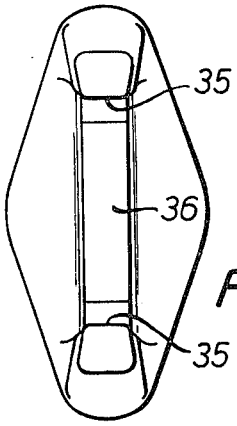
FIG. 5 is a view of the crutch in the direction of the arrow IV in FIG. 3.
Figure 6:
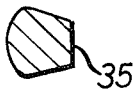
FIG. 6 is a detail cross-section on the line V—V in FIG. 3.

As shown in the detail views of FIGS. 4 to 6 the crutch recess 22 is defined by flat parallel side faces 35 and a flat bottom face 36 so that the housing 17*a* of the corresponding unit 14 is closely received and seats firmly in the support crutch 6 without any relative fretting movement when the corresponding handle 15 is turned.

Figure 3:
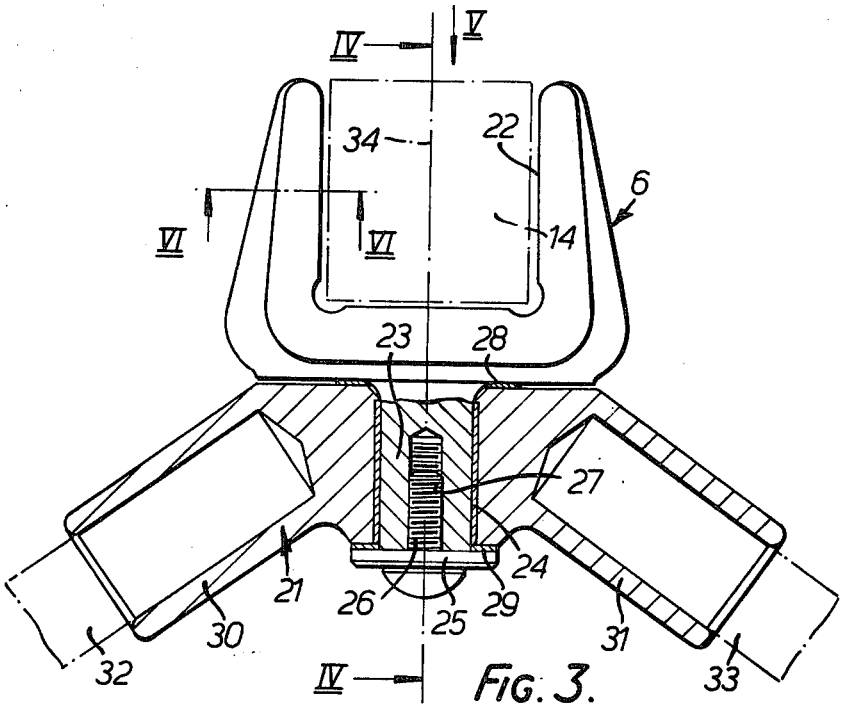
FIG. 3 is a cross-sectional detail view of an end support crutch of the embodiment.
Figure 7:
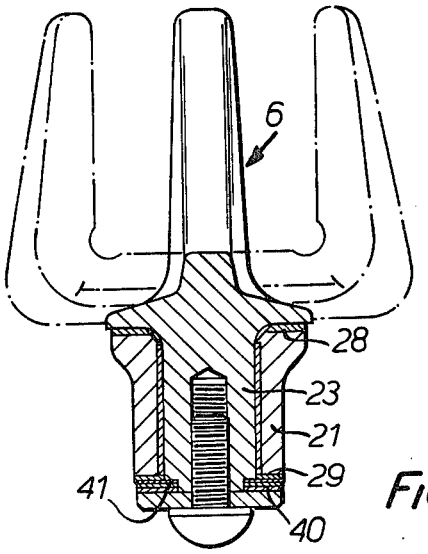
FIG. 7 is a detail view of a modification.

FIG. 7 illustrates a modification which provides a preset degree of frictional loading to the pivot bearings of the support crutches 5 and 6. As compared with the view of FIG. 3, FIG. 7 shows that the modification introduces a "wavy" spring washer 40 between the location washer 25 and the thrust washer 29. This washer 40 is under axial preload such as to provide a preset fictional restraint in the bearing so that the crutch 6 (or 5) does not spin freely and hence stays where it is placed. This assists fitting of a shaft assembly, leaving a nurse fitting up the bed with both hands free to handle each shaft assembly as it is fitted. To control the axial preload of the washer 40, the extended spindle 23 of the crutch has a reduced diameter end extension, providing a step 41 against which the washer 40 seats and is held by the washer 25. The washer 40 may be of beryllium copper with thrust washers 28 and 29 of nylon, for example.

I claim:

1. A bed of the type which supports a patient on a flexible web slung between two generally parallel shafts on to which the ends of the web are respectively wound, comprising:

a framework having two spaced support crutches at each end thereof; and two shafts which include end fittings respectively providing bearings which demountably support the ends of each shaft in a corresponding two of said support crutches of said framework, one of said end fittings of each shaft comprising a plain bearing assembly having an annular bearing member which engages directly in the corresponding one of said support crutches and the other of said end fittings of each shaft comprising a combined bearing and drive clutch/brake unit with a non-circular housing which non-rotatably engages in the corresponding one of said support crutches, each end of said shaft being held captive with respect to the framework by means of a member such as a chain or cord of such length that when one end of a shaft is lifted out of the corresponding support crutch and lowered so as to hang freely on the corresponding chain or cord it is constrained to move inside of an arc such that the resultant universal angular movement of the other end of that shaft, which remains in the associated support crutch, lies within a permissible range at all times during thhe lowering movement, said bearing member, housing and support crutches being formed to provide said permissible range of free angular movement at each support crutch with such free movement at the corresponding end of each shaft being achieved by forming said plain bearing member thereof with adequate clearance relative to the corresponding support crutch.

2. A bed according to claim 1, wherein at said other end of each shaft, said permissible range of angular movement is achieved by suitable formation or mounting of the corresponding crutch so that said non-circular housing remains a good non-rotational fit within the crutch to avoid fretting of the interengaging housing and crutch surfaces.

3. A bed according to claim 1, wherein said non-circular housing is a non-rotational fit within a crutch which is pivotally mounted in the framework so as to pivot in the manner of a rowlock of a rowboat.

4. a bed according to claim 3, wherein two pivotal crutches of the framework have non-circular recesses which closely receive the end fittings having non-circuar housings, respectively, which recesses are of different sizes whereby the shaft/framework combination is "handed" and the two shafts can only be fitted at the correct sides of the bed.

5. A bed according to claim 3, wherein each of the two pivotal crutches comprises a shaft-supporting portion with a generally rectangular recess to receive the housing of the corresponging shaft end fitting, and a projecting pivot spindle pivotally received in a bearing in a corresponding angular corner fitting of the framework.

6. A bed according to claim 5, wherein pivot axes of said pivotal crutches are upwardly and outwardly inclined at an angle of the order of 55° to the horizontal.

7. A bed according to claim 5, wherein pivotal movement of the pivotal crutches is subject to frictional restraint, whereby they do not spin freely in the pivot bearings but tend to stay where placed, whereby to assist an operator when fitting the shafts to the framework.

8. A bed according to claim 7, wherein said frictional restraint is provided by axially preloaded spring washers respectively associated with the spindles of the pivotal crutches.

* * * * *